US005388697A

United States Patent [19]

James

[11] Patent Number: 5,388,697

[45] Date of Patent: Feb. 14, 1995

[54] BEVERAGE IDENTIFICATION SYSTEM

[76] Inventor: Gregory L. James, 2400 S. Loop West #1413, Houston, Tex. 77054

[21] Appl. No.: 99,902

[22] Filed: Jul. 19, 1993

[51] Int. Cl.[6] ..... B65D 73/00

[52] U.S. Cl. ..... 206/459.5; 220/574.1; 220/705; 116/200

[58] Field of Search ..... 206/459.5; 220/503, 220/505, 507, 556, 574.1, 575, 705; 40/564, 574, 586, 633; 362/98, 99, 103, 108, 154, 253; 224/219, 222, 225, 270, 901; 116/200, 234, 239

[56] References Cited

U.S. PATENT DOCUMENTS

| | | | |
|---|---|---|---|
| 753,457 | 3/1904 | Weissbrod | 224/219 |
| 1,673,595 | 6/1928 | Scoggins | 40/586 |
| 2,510,646 | 6/1950 | Meers | 224/270 |
| 3,145,841 | 8/1964 | McGuire | 206/459.5 |
| 3,215,453 | 11/1965 | Malcom, Jr. | 362/99 |
| 3,347,358 | 10/1967 | Meyers | 206/459.5 |
| 3,908,877 | 9/1975 | Kosisky | 206/459.5 |
| 4,195,059 | 3/1980 | Whitcher et al. | 206/459.5 |
| 4,349,338 | 9/1982 | Heppler | 206/459.5 |
| 5,161,687 | 11/1992 | Kornell et al. | 206/459.5 |
| 5,191,979 | 3/1993 | Nemeroff | 206/459.5 |

*Primary Examiner*—Ira S. Lazarus
*Assistant Examiner*—Alan B. Cariaso

[57] ABSTRACT

A new and improved beverage identification system includes a plurality of coded classes of drink coding members, e.g. straws, wherein each coded class of the drink coding members is associated with a class code indicia, e.g. different colors. Each class code indicia is in a predetermined one-to-one correspondence with a type of drink, and each drink coding member of each respective coded class carries the respective class code indicia. A plurality of coded receiver compartments receive the respective coded classes of the drink coding members. Each of the coded receiver compartments is associated with one of the respective class code indicia, such that a one-to-one correspondence is established between each respective type of drink and each of the respective coded receiver compartments. A decoding device indicates the predetermined one-to-one correspondence between each class code indicia and each type of drink. The decoding device may be a card which includes a first array of class code indicia and a second array of drink identification information in one-to-one correspondence with the class code indicia. The decoding device may be attached to a wearer's body. An illumination assembly may be in a housing which supports the decoding device and may light the decoding device by backlighting. An on/off switch may be connected to the illumination assembly by a connector cable and may include a ring support for attaching the on/off switch assembly to a finger of a wearer.

6 Claims, 4 Drawing Sheets 12
12
12
12
16
16
16
16
16
13
14
14
14
14
14
13
13
13
16
16
16
16
14
14
2
16
14
14
14
13
17
2
23

12
12
12
12
14
14
13
13
13
17
14
14
23

BEVERAGE IDENTIFICATION SYSTEM

BACKGROUND OF THE INVENTION

1. Field of the Invention

The present invention relates generally to communication systems, and, more particularly, to a communication system for communicating the identity of a beverage between a bartender and a waiter or waitress.

2. Description of the Prior Art

In a restaurant or bar having table service, beverages both alcoholic and nonalcoholic, are prepared by a bartender and delivered to a patron by a waiter or waitress. Oftentimes, the bartender prepares a plurality of beverages (drinks), sets them onto a counter, and goes on to prepare other drinks. In the interim, the waiter or waitress comes to the counter, sees the drinks, and retrieves them for delivery to a patron.

There are a number of problems associated with this commonly used system. First, the bartender, having prepared a plurality of different types of drinks, may forget which specific drink was of which specific type. Sometimes the visual appearance of the drink itself clearly identifies different drinks. For example, one drink may be colored pink, another orange, and another brown. However, many different drinks have a very similar appearance. For example, drinks known as Jack Black and Coke, Turkey and Coke, and Wellers; and Coke all look the same. Different types of drinks that look the same pose a large problem for drink identification. In this respect, it would be desirable if a drink identification system were provided which enables a bartender to identify different types of drinks that look the same.

Another problem associated with the conventional drink preparation and delivery system relates to the waiter or waitress. Just as the bartender has difficulty in differentiating between different drinks that look alike, so do the waiter or waitress. Actually it is more of problem for a waiter or waitress. There may be many drinks on a counter prepared for delivery by many waiters or waitresses. In this complex environment, it is very easy for a waiter or waitress to pick up the wrong drink and deliver someone else's drink to the wrong patron. Such wrong deliveries are very embarrassing to the waiter or waitress and reflect poorly on the reputation of the establishment. In this respect, it would be desirable if a drink identification system were provided that enabled a waiter or waitress to identify different types of drinks that look the same.

In a drink purveying establishment, there are slow times when a bartender may be able to speak to a waiter or waitress and tell them specifically about the contents of each drink. However, there are many times when it is not possible for a bartender to speak directly with a waiter or waitress about the contents of the drinks on the counter. In this respect, it would be desirable if a drink identification system were provided which enabled a communication as to drink contents without a bartender speaking to a waiter or waitress about the drink contents.

Throughout the years, a number of innovations have been developed relating to storing a number of small items in an organized manner, and the following patents are representative of some of those innovations: U.S Pat. Nos. 3,442,393; 5,062,531; Des. 252,492; Des. 282,336; and Des. 286,329. More specifically, U.S. Pat. No. 3,442,393 discloses a holder that stores napkins, condiments, straws, and packets. U.S. Pat. No. 5,062,531 discloses a caddy for storing a number of medicine containers which have different size recesses for storing different size medicine containers. U.S. Pat. No. Des. 252,492 discloses a combined condiment and napkin holder in the form of a miniature picnic table. U.S. Pat. No. Des. 282,336 discloses a condiment holder and organizer in the form of a two-tiered structure. U.S. Pat. No. Des. 286,329 discloses a compartmented tray for organizing a plurality of cosmetics.

It is noted that none of the U.S. patents cited above is there any disclosure of a system for beverage identification so as to communicate the contents of a beverage from one person (a bartender) to another person (a waiter or waitress).

In a beverage identification system there are certain additional features that would be desirable. With a beverage identification system using a coded system, it would be desirable if the content of the code is readily displayed for easy decoding by both the bartender and waiter or waitress. A food or drink establishment is a place where spills or food or drink often occur. In this respect, it would be desirable if a drink identification system were provided which protected a decoding display from spills of food or drink.

Just before a waiter or waitress makes the delivery of a drink to a patron, it would be desirable if the waiter or waitress could make a last minute check of the identity of the drink to verify the propriety of the delivery. A waiter or waitress often has their hands filled with food or drink being delivered, and, under these circumstances, it would be inconvenient for the waiter or waitress to have to put the food or drink down to take out a decoding device to verify the contents of the drinks. In this respect, it would be desirable if a drink identification system were provided with a decoding device that is worn by a waiter or waitress so the waiter or waitress could refer to the decoding device without having to put the food or drink down to refer to the decoding device.

An establishment purveying food or drink is often relatively dark in areas where patrons sit. Under these circumstances, it may be difficult for a waiter or waitress to see a decoding device. In this respect, it would be desirable if a drink identification system were provided which included a decoding device which carried its own source of illumination so that it can be seen in dimly lit areas.

For an illumination device worn by a waiter or waitress, it is desirable that the device be illuminated only when the waiter or waitress elects to turn on the illumination. This feature is desirable to conserve battery power. Yet, just as the illumination device for the decoder should not occupy the hand of the waiter or waitress, a switch to actuate the illumination device should also not occupy the hand of the waiter or waitress. In this respect, it would be desirable if a drink identification system were provided which included an electrical switch for a decoder illumination device which did not occupy a whole hand of a waiter or waitress.

Thus, while the foregoing body of prior art indicates it to be well known to use a device to organize items in a bar or restaurant, the prior art described above does not teach or suggest a beverage identification system which has the following combination of desirable features: (1) enables a bartender to identify different types of drinks that look the same; (2) enables a waiter or waitress to identify different types of drinks that look the same; (3) enables a communication as to drink contents without a bartender speaking to a waiter or waitress about the drink contents; (4) readily displays the content of the code for easy decoding by both the bartender and waiter or waitress; (5) protects a decoding display from spills of food or drink; (6) is worn by a waiter or waitress so the waiter or waitress can refer to the decoding device without having to put the food or drink down to refer to the decoding device; (7) includes a decoding device which carries its own source of illumination so that it can be seen in dimly lit areas; and (8) includes an electrical switch for a decoder illumination device which does not occupy a whole hand of a waiter or waitress. The foregoing desired characteristics are provided by the unique beverage identification system of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved beverage identification system which includes a plurality of coded classes of drink coding members, wherein each coded class of the drink coding members is associated with a class code indicia. Each class code indicia is in a predetermined one-to-one correspondence with a type of drink, and each drink coding member of each respective coded class carries the respective class code indicia. A plurality of coded receiver compartments receive the respective coded classes of the drink coding members. Each of the coded receiver compartments is associated with one of the respective class code indicia, such that a one-to-one correspondence is established between each respective type of drink and each of the respective coded receiver compartments. A decoding device indicates the predetermined one-to-one correspondence between each class code indicia and each type of drink.

The drink coding members are comprised of straws. Some of the drink coding members are comprised of drinking straws. Other of the drink coding members are comprised of stirring straws.

Preferably, the class code indicia are comprised of different colors, wherein each respective color has a predetermined one-to-one correspondence with a respective type of drink. The decoding device may be a card which includes a first array of class code indicia and a second array of drink identification information in one-to-one correspondence with the class code indicia. A napkin holder may be attached to two respective sides of two coded receiver compartments. A match holder may be attached to at least one of the coded receiver compartments.

A transparent, protective retainer for receives the decoding card. The transparent, protective retainer includes a receiving chamber and a lid.

An attachment assembly attaches the decoding device to a wearer's body. The attachment assembly includes a housing for supporting the decoding device. Straps are connected to the housing, for connecting the housing to an arm of a person. The housing includes a liftable cover which permits the decoding device to be selectively placed in or removed from the housing. The liftable cover may include a pair of hinges for connecting the cover to the housing. A transparent top protector covers and protects the decoding device when the decoding device is supported by the housing. The liftable cover is in the form of a frame which frames the transparent top protector.

The straps include a first strap which includes a first end attached to the housing and a second end which includes a first connector. A second strap includes a first end attached to the housing and a second end which includes a second connector, such that the housing can be placed on a wearer's arm. The straps can be extended to encompass the wearer's arm, and the first and second connectors can be connected, whereby the attachment assembly is attached to the wearer's arm. The first connector and the second connector are complementary hook and loop material.

An illumination assembly may be housed in the housing which supports the decoding device. The illumination assembly is located under the decoding device and lights up the decoding device enabling the decoding device to be read from light emitted from the illumination assembly. The illumination assembly includes a battery. A battery-powered lamp is connected to the battery, and an on/off switch assembly is connected between the battery and the lamp for controlling whether the lamp is on or off. A transparent bottom protector is located between the lamp and the decoding device for permitting light from the lamp to backlight the decoding device.

The on/off switch assembly may be located external to the housing. The external on/off switch assembly is connected to the battery and the lamp by a connector cable. The on/off switch assembly may include a ring support for attaching the on/off switch assembly to a finger of a wearer. The external on/off switch assembly includes a ring-mounted housing which includes a rigid bottom wall and a flexible top wall. The rigid bottom wall includes a first conductive plate which is connected to the connector cable, and the flexible top wall includes a second conductive plate which is connected to the connector cable.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved beverage identification system which has all of the advantages of the prior art and none of the disadvantages.

It is another object of the present invention to provide a new and improved beverage identification system which may be easily and efficiently manufactured and marketed.

It is a further object of the present invention to provide a new and improved beverage identification system which is of durable and reliable construction.

An even further object of the present invention is to provide a new and improved beverage identification system which is susceptible of a low cost of manufacture with regard to both materials and labor, and which accordingly is then susceptible of low prices of sale to the consuming public, thereby making such beverage identification system available to the buying public.

Still yet a further object of the present invention is to provide a new and improved beverage identification system which enables a bartender to identify different types of drinks that look the same.

Still another object of the present invention is to provide a new and improved beverage identification system that enables a waiter or waitress to identify different types of drinks that look the same.

Yet another object of the present invention is to provide a new and improved beverage identification system which enables a communication as to drink contents without a bartender speaking to a waiter or waitress about the drink contents.

Even another object of the present invention is to provide a new and improved beverage identification system that readily displays the content of the code for easy decoding by both the bartender and waiter or waitress.

Still a further object of the present invention is to provide a new and improved beverage identification system which protects a decoding display from spills of food or drink.

Yet another object of the present invention is to provide a new and improved beverage identification system that is worn by a waiter or waitress so the waiter or waitress can refer to the decoding device without having to put the food or drink down to refer to the decoding device.

Still another object of the present invention is to provide a new and improved beverage identification system which includes a decoding device which carries its own source of illumination so that it can be seen in dimly lit areas.

An even further object of the present invention is to provide a new and improved beverage identification system that includes an electrical switch for a decoder illumination device which does not occupy a whole hand of a waiter or waitress.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
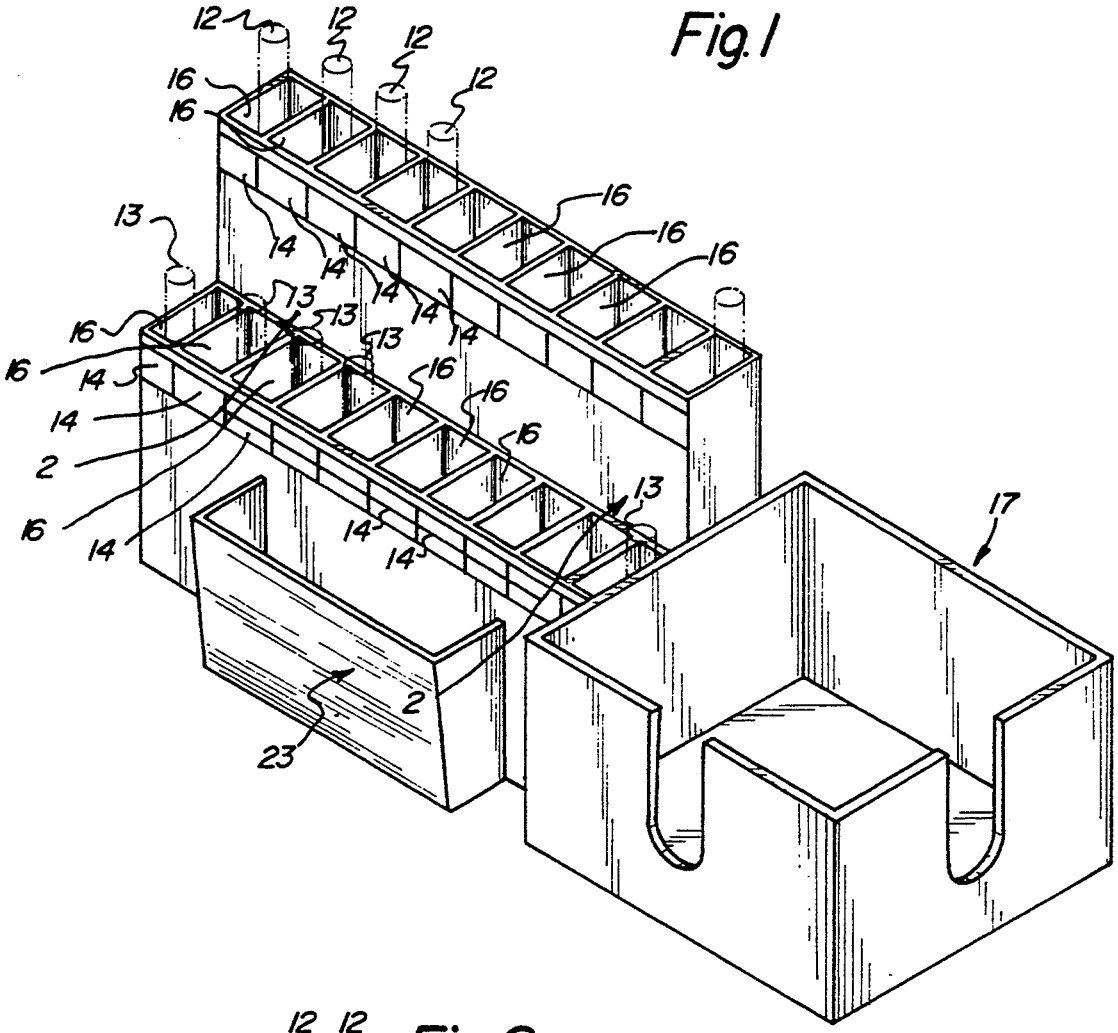
FIG. 1 is a perspective view showing coding assembly of a first preferred embodiment of the beverage identification system of the invention.

With reference to the drawings, a new and improved beverage identification system embodying the principles and concepts of the present invention will be described.

Turning initially to FIGS. 1–4 and taking them together, there is shown a first exemplary embodiment of the beverage identification system of the invention. In its preferred form, the beverage identification system includes a plurality of coded classes of drink coding members 12, wherein each coded class of the drink coding members 12 is associated with a class code indicia 14. Each class code indicia 14 is in a predetermined one-to-one correspondence with a type of drink, and each drink coding member 12 of each respective coded class exhibits the respective class code indicia 14. A plurality of coded receiver compartments 16 receive the respective coded classes of the drink coding members 12. Each of the coded receiver compartments 16 is associated with one of the respective class code indicia 14, such that a one-to-one correspondence is established between each respective type of drink and each of the respective coded receiver compartments 16. A decoding device 18 indicates the predetermined one-to-one correspondence between each class code indicia 14 and each type of drink. In use, a drink coding member 12 is taken from a coded receiver compartment and is placed in a drink to identify the type of drink.

A single decoding device 18 can be located so that both the bartender and the waiters or waitresses can easily see it. Alternatively, the bartender and each of the waiters and waitresses can be provided with personal decoding devices 18 so that their personal devices can be readily consulted wherever the person is located.

With the beverage identification system of the invention, communication between the bartender and the waiters and waitresses, the memory of the bartender as to which drinks were prepared, and the memory of the waiters and waitresses about which drinks are which are not necessary to assure correct delivery of identified drinks. The waiter or waitress needs only to notice the drink coding member 12 sitting in a drink and consult the decoding device 18 to be sure of the identity of the drinks to be delivered.

Figure 2:
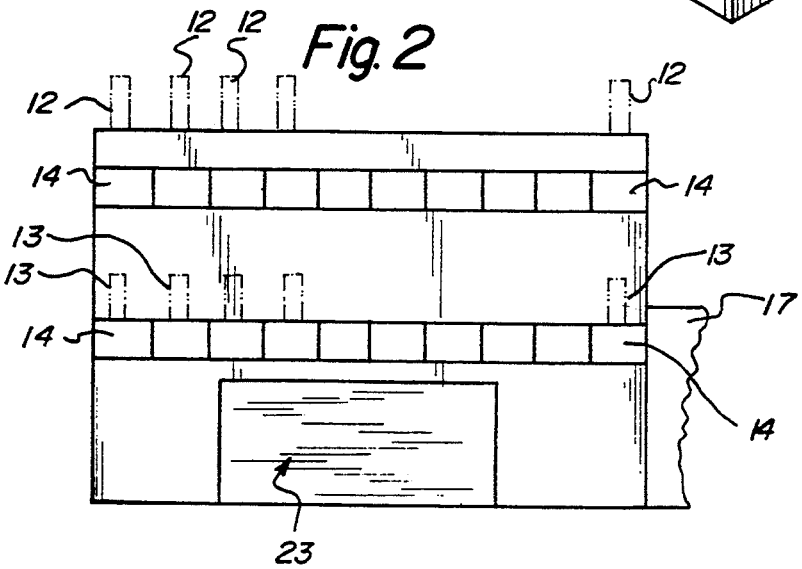
FIG. 2 is a partial front view of the coding assembly of the beverage identification system shown in FIG. 1 taken along line 2—2 thereof.

In FIGS. 1 and 2, the drink coding members 12 are comprised of straws. Some of the drink coding members are comprised of drinking straws. Other of the drink coding members are comprised of stirring straws 13. If desired, a drink associated with a relatively long drinking straw and a given color can be differentiated from a different drink associated with a relatively short stirring straw of the same color. Thus, in this way, the same class code indicia 14 (same color) can be used to identify two different drinks, one associated with the drinking straw and the other associated with the stirring straw.

Preferably, the class code indicia 14 are comprised of different colors, wherein each respective color has a predetermined one-to-one correspondence with a respective type of drink. If desired, other criteria besides different colors can be used as class code indicia 14. For example, a respective sequence of numbers can be used. A given number would associated with each respective class code indicia 14, and a respective plurality of straws and a respective straw receiver compartment would also be associated with the given number. Still alternatively, other symbols could be used for class code indicia 14 that would be used on a respective plurality of drink coding members 12 and a respective coded receiver compartment 16.

Figure 3:
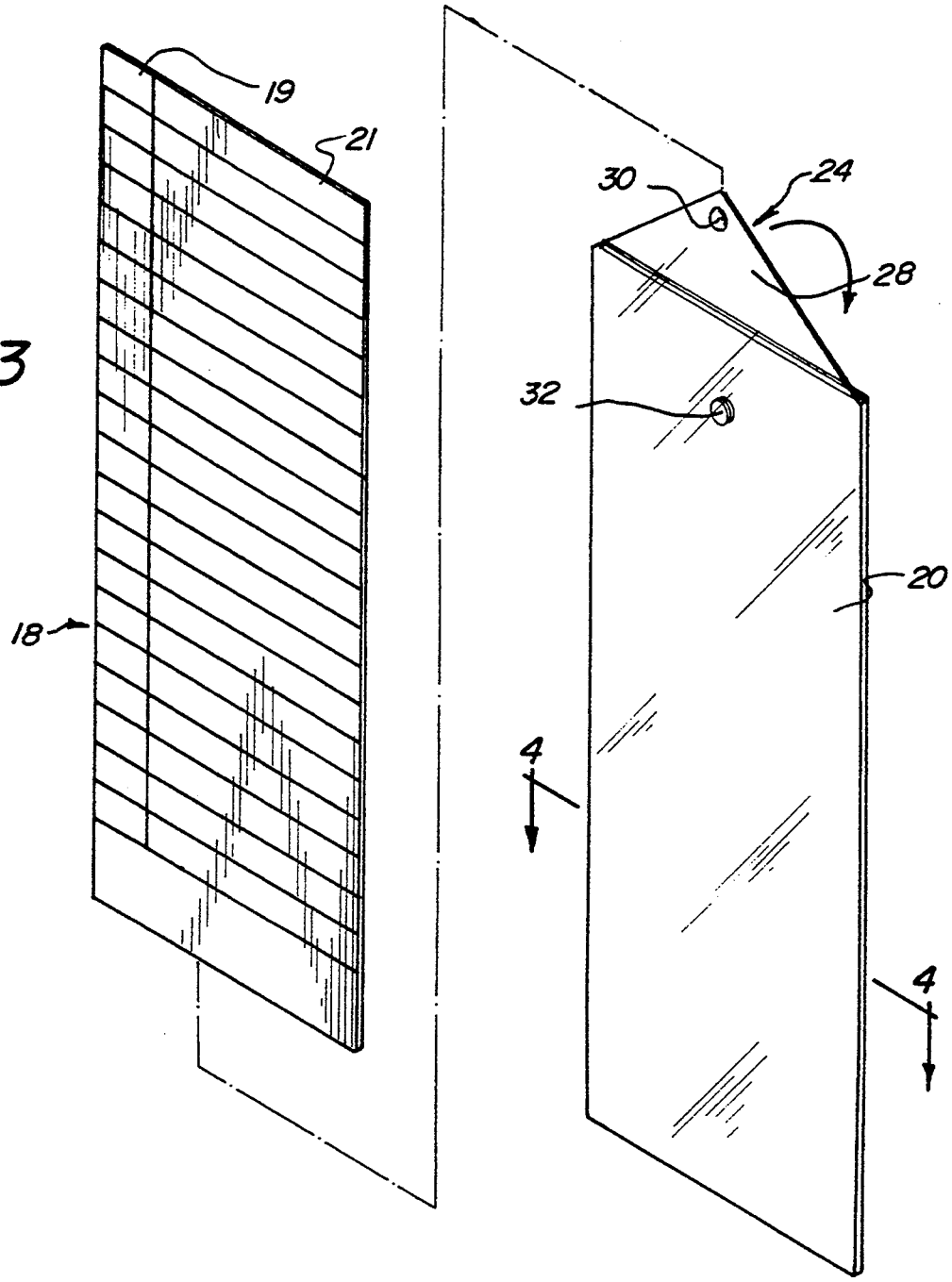
FIG. 3 is an exploded perspective view of a decoding assembly of the beverage identification system of FIG. 1 wherein the decoding assembly is provided with a clear plastic retainer.
Figure 4:
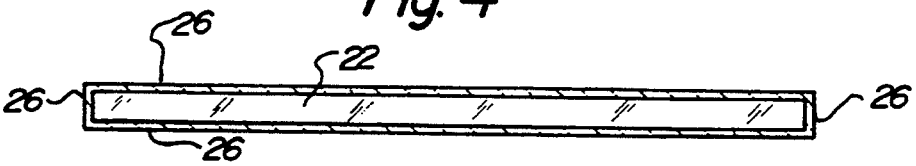
FIG. 4 is a cross-sectional view of the clear plastic retainer shown in FIG. 3 taken along line 3—3 thereof.

As shown in FIGS. 1 and 2, there are ten coded receiver compartments 16 that receive tall drinking straws 12. There are ten coded receiver compartments 16 that receive short stirring straws 13. When the class code indicia 14 includes ten different colors, a total of twenty different drinks are coded by the system of the invention shown in FIGS. 1 and 2. As shown in FIG. 3, the decoding device 18 is a card 18 which includes a first array 19 of class code indicia 14 and a second array 21 of drink identification information in one-to-one correspondence with the class code indicia 14. The card 18 in FIG. 3 has provision for twenty different drinks. That is, the first array 19 includes twenty cells, and the second array 21 includes twenty cells. If desired, more than twenty or less than twenty drinks can be coded. Napkin holder 17 is attached to two respective sides of two coded receiver compartments 16. A match holder 23 is attached to at least one of the coded receiver compartments 16.

A transparent, protective retainer 20 receives the decoding card 18. The transparent, protective retainer 20 includes a receiving chamber 22 and a lid 24. The receiving chamber 22 is defined by a plurality of walls 26. The lid 24 includes a flap portion 28 is connected to one of the walls 26 and also includes a first closure member 30 to engage a complementary second closure member 32 affixed to one of the walls 26.

Figure 5:
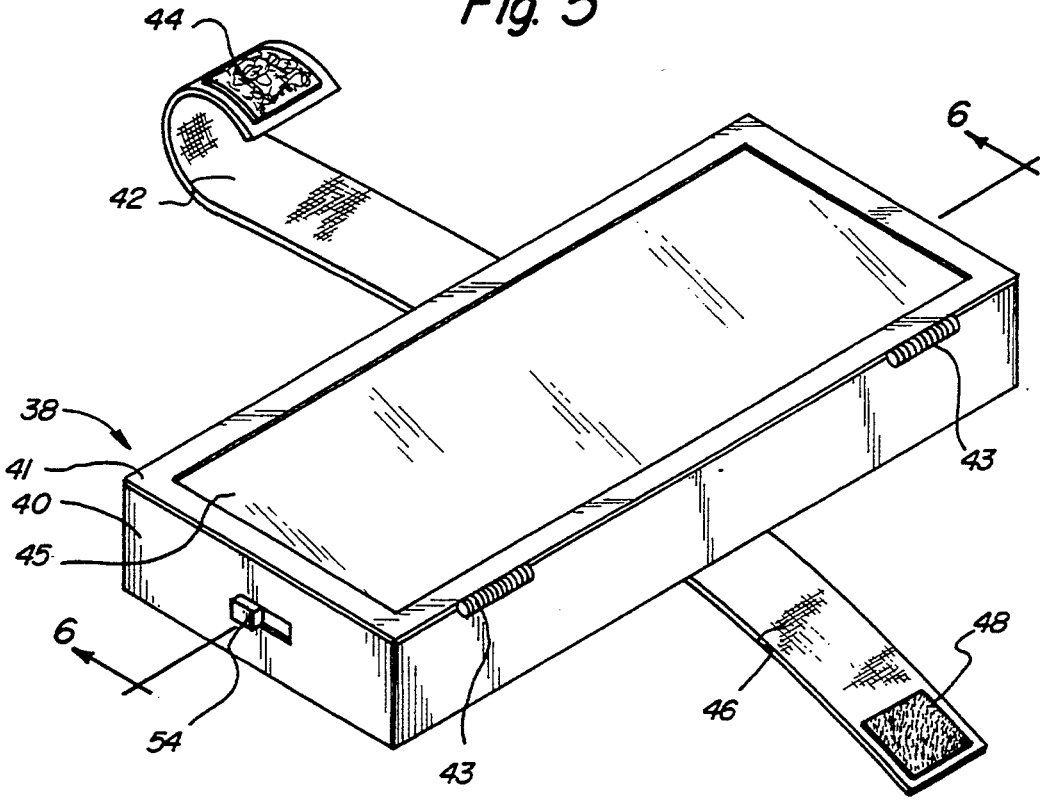
FIG. 5 is a perspective view of a second embodiment of a retainer for a decoder assembly of the invention, wherein the retainer is worn of the arm of the waiter or waitress and contains a source of illumination.
Figure 6:
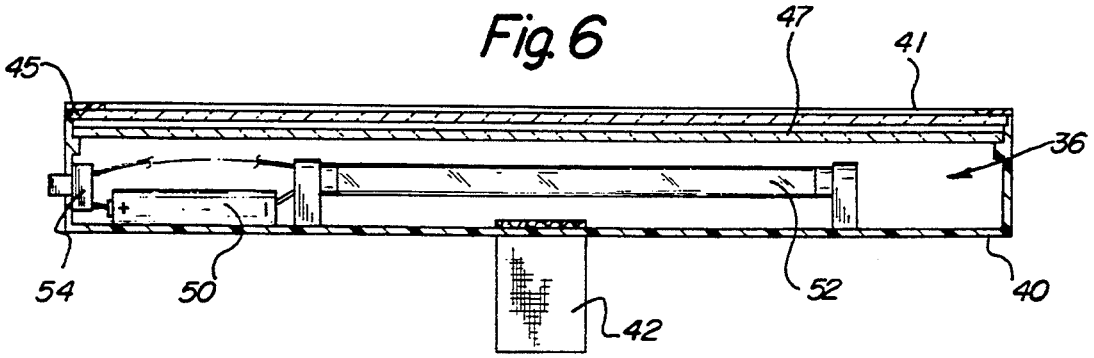
FIG. 6 is a cross-sectional view of the arm-worn, illuminated decoder retainer shown in FIG. 5 taken along the line 6—6 of FIG. 5.

Turning to FIGS. 5–6, a second embodiment of the invention is shown. Reference numerals are shown that correspond to like reference numerals that designate like elements shown in the other figures. In addition, an attachment assembly 38 attaches the decoding device 18 to a wearer's body. The attachment assembly 38 includes a housing 40 for supporting the decoding device 18. Straps are connected to the housing 40, for connecting the housing 40 to an arm of a person. The housing 40 includes a liftable cover 41 which permits the decoding device 18 to be selectively placed in or removed from the housing 40. The liftable cover 41 includes a pair of hinges 43 for connecting the cover 41 to the housing 40. A transparent top protector 45 covers and protects the decoding device 18 when the decoding device 18 is supported by the housing 40. The liftable cover 41 is in the form of a frame which frames the transparent top protector 45.

The straps include a first strap 42 which includes a first end attached to the housing 40 and a second end which includes a first connector 44. A second strap 46 includes a first end attached to the housing 40 and a second end which includes a second connector 48, such that the housing 40 can be placed on a wearer's arm. The straps can be extended to encompass the wearer's arm, and the first and second connectors can be connected, whereby the attachment assembly 38 is attached to the wearer's arm. The first connector 44 and the second connector 48 are complementary hook and loop, e.g. VELCRO (TM), material.

An illumination assembly 36 is housed in the housing 40 which supports the decoding device 18. The illumination assembly 36 is located under the decoding device 18 and lights up the decoding device 18 enabling the decoding device 18 to be read from light emitted from the illumination assembly 36. The illumination assembly 36 includes a battery 50. A battery-powered lamp 52 is connected to the battery 50, and an on/off switch assembly 54 is connected between the battery 50 and the lamp 52 for controlling whether the lamp 52 is on or off. A transparent bottom protector 47 is located between the lamp 52 and the decoding device 18 for permitting light from the lamp 52 to backlight the decoding device 18. With the backlighting, the decoding device 18 can be readily seen in darkened areas.

Figure 7:
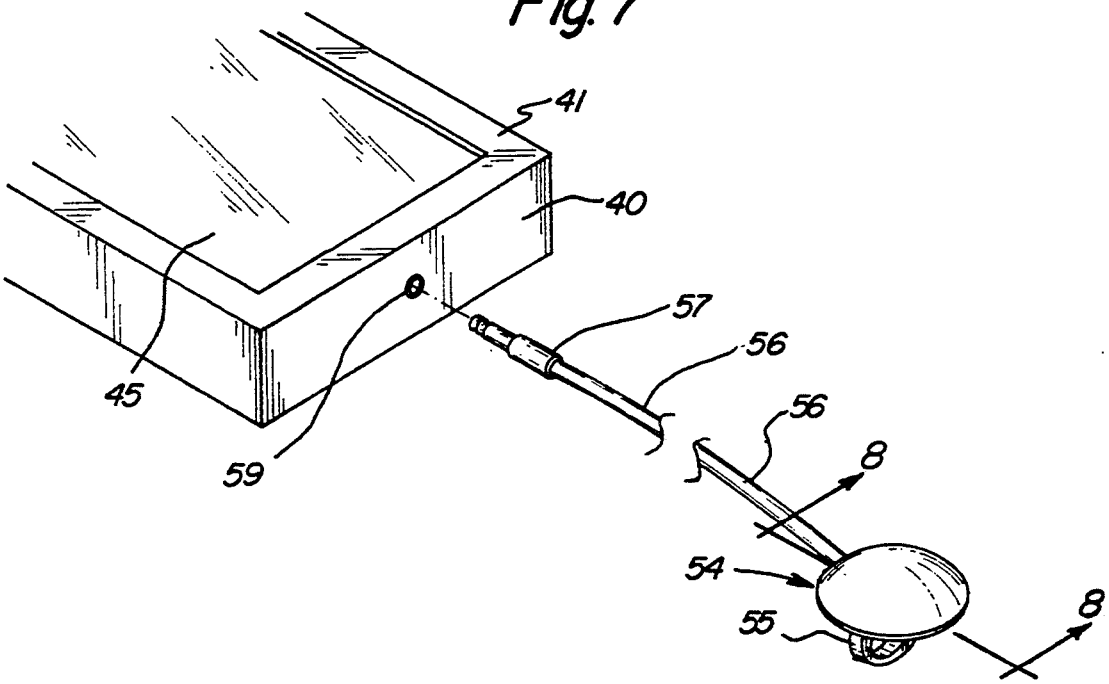
FIG. 7 is a partial perspective view of a third embodiment of a retainer for a decoder assembly of the invention, wherein the arm-worn, illuminated decoder assembly retainer is actuated by a finger-carried electrical switch.
Figure 8:
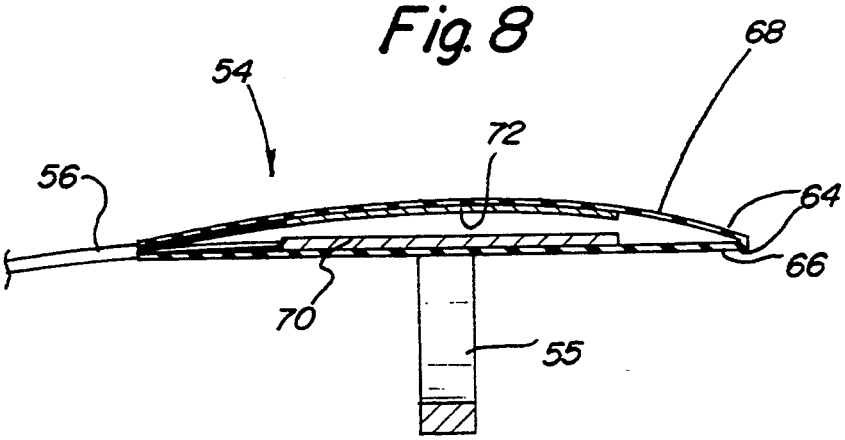
FIG. 8 is an enlarged cross-sectional view of the finger-carried electrical switch shown in FIG. 7 taken along the line 8—8 thereof.

Turning to FIGS. 7–8, a third embodiment of the invention is shown. Reference numerals are shown that correspond to like reference numerals that designate like elements shown in the other figures. In addition, the on/off switch assembly 54 is located external to the housing 40. The external on/off switch assembly 54 is connected to the battery 50 and the lamp 52 by a connector cable 56. The connector cable 56 has a plug 57 for connecting to a complementary jack 59 in the housing 40. The on/off switch assembly 54 includes a ting support 55 for attaching the on/off switch assembly 54 to a finger of a wearer. The external on/off switch assembly 54 includes a ring-mounted housing 64 which includes a rigid bottom wall 66 and a flexible top wall 68. The rigid bottom wall 66 includes a first conductive plate 70 which is connected to the connector cable 56, and the flexible top wall 68 includes a second conductive plate 72 which is connected to the connector cable 56.

The flexible top wall 68 normally causes the first conductive plate 70 to be separated from the second conductive plate 72, so that the on/off switch is in the open or off position. However, when some gentle pressure is exerted on the top side of the flexible top wall 68, the wall is moved toward the rigid bottom wall 66, whereby the first conductive plate 70 contacts the second conductive plate 72, and the on/off switch is switched to the on position whereby the circuit to the lamp from the battery is dosed, and the lamp 52 provides illumination for the decoding device 18. The pressure exerted on the top side of the flexible top wall 68 can be exerted by the wearer pressing the top wall 68 against a hard surface such as a table top without letting go of anything that is grasped by the hand of the wearer.

The components of the beverage identification system of the invention can be made from inexpensive and durable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved beverage identification system that is low in cost, relatively simple in design and operation, and which may advantageously be used to provide a beverage identification system which enables a bartender to identify different 'types of drinks that look the same. With the invention, a beverage identification system is provided which enables a waiter or waitress to identify different types of drinks that look the same. With the invention, a beverage identification system is provided which enables a communication as to drink contents without a bartender speaking to a waiter or waitress about the drink contents. With the invention, a beverage identification system is provided which readily displays the content of the code for easy decoding by both the bartender and waiter or waitress. With the invention, a beverage identification system is provided which protects a decoding display from spills of food or drink. With the invention, a beverage identification system is provided which is worn by a waiter or waitress so the waiter or waitress can refer to the decoding device without having to put the food or drink down to refer to the decoding device. With the invention, a beverage identification system is provided which includes a decoding device which carries its own source of illumination so that it can be seen in dimly lit areas. With the invention, a beverage identification system is provided which includes an electrical switch for a decoder illumination device which does not occupy a whole hand of a waiter or waitress.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved beverage identification system, comprising:

a plurality of coded classes of drink coding members adapted to be placed within a drink, each coded class of said drink coding members associated with a class code indicia, each class code indicia being in a predetermined one-to-one correspondence with a type of drink, and each drink coding member of each respective coded class carrying the respective class code indicia, a plurality of coded receiver compartments for receiving said respective coded classes of said drink coding members, each of said coded receiver compartments associated with one of said respective class code indicia, such that a one-to-one correspondence is established between each respective type of drink and each of said respective coded receiver compartments, and a decoding device which indicates the predetermined one-to-one correspondence between each class code indicia and each type of drink.

2. The apparatus described in claim 1 wherein said drink coding members are comprised of straws.

3. The apparatus described in claim 1 wherein said class code indicia are comprised of different colors, each respective color having a predetermined one-to-one correspondence with a respective type of drink.

4. The apparatus described in claim 1 wherein said decoding device is a card which includes a first array of class code indicia and a second array of drink identification information in one-to-one correspondence with said class code indicia.

5. The apparatus described in claim 4, further including:

a transparent, protective retainer for receiving said decoding card.

6. The apparatus described in claim 5 wherein said transparent, protective retainer includes a receiving chamber and a lid.

* * * * *